US012092390B2

(12) United States Patent
Chhajed et al.

(10) Patent No.: US 12,092,390 B2
(45) Date of Patent: Sep. 17, 2024

(54) REFRIGERATOR APPLIANCE WITH CONVERTIBLE COMPARTMENT

(71) Applicant: WHIRLPOOL CORPORATION, Benton Harbor, MI (US)

(72) Inventors: Rahul Chhajed, Pune (IN); Ritesh Shantilal Solanki, Vasai (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/749,288

(22) Filed: May 20, 2022

(65) Prior Publication Data

US 2023/0375255 A1 Nov. 23, 2023

(51) Int. Cl.

| | |
|---|---|
| ***F25D 11/02*** | (2006.01) |
| ***F25B 29/00*** | (2006.01) |
| ***F25B 41/20*** | (2021.01) |
| ***F25B 49/02*** | (2006.01) |
| ***F25D 23/06*** | (2006.01) |
| ***F25D 23/12*** | (2006.01) |
| ***F25D 31/00*** | (2006.01) |

(52) U.S. Cl.

CPC ..... *F25D 23/12* (2013.01); *F25B 29/003* (2013.01); *F25B 41/20* (2021.01); *F25B 49/027* (2013.01); *F25D 11/02* (2013.01); *F25D 23/068* (2013.01); *F25D 31/005* (2013.01); *F25D 2400/02* (2013.01); *F25D 2400/16* (2013.01)

(58) Field of Classification Search

CPC ..... F25D 11/02; F25D 23/068; F25D 23/12; F25D 31/005; F25D 2400/02; F25D 2400/16

See application file for complete search history.

(56) References Cited

U.S. PATENT DOCUMENTS

| | | | | |
|---|---|---|---|---|
| 2,102,171 | A * | 12/1937 | Vandoren | F25D 31/002 62/394 |
| 9,335,086 | B2 | 5/2016 | Koo et al. | |
| 2018/0335242 | A1* | 11/2018 | Besore | F25B 41/24 |
| 2019/0032985 | A1 | 1/2019 | Babucke et al. | |
| 2019/0145674 | A1 | 5/2019 | Yi et al. | |

FOREIGN PATENT DOCUMENTS

| | | | |
|---|---|---|---|
| CN | 105698463 | A | 6/2016 |
| CN | 108613453 | A | 10/2018 |
| CN | 107367125 | | 12/2019 |
| CN | 111435052 | A | 7/2020 |
| WO | 2021179734 | A1 | 9/2021 |

* cited by examiner

*Primary Examiner* — Jonathan Bradford

(74) *Attorney, Agent, or Firm* — Brooks Kushman P.C.

(57) ABSTRACT

A refrigerator appliance includes a refrigerator compartment, a freezer compartment, and a convertible compartment. The convertible compartment is defined by a liner and is configured to selectively transition between a secondary refrigerator compartment and a secondary freezer compartment. A heating coil is wrapped around the liner with the coil extending over at least two exterior walls of the liner.

19 Claims, 3 Drawing Sheets

REFRIGERATOR APPLIANCE WITH CONVERTIBLE COMPARTMENT

TECHNICAL FIELD

The present disclosure relates to an appliance such as a refrigerator.

BACKGROUND

In order to keep food fresh, a low temperature must be maintained within a refrigerator to reduce the reproduction rate of bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a refrigerator compartment, a freezer compartment, and a convertible compartment. The convertible compartment is defined by a liner and is configured to selectively transition between a secondary refrigerator compartment and a secondary freezer compartment. A heating coil is wrapped around the liner with the coil extending over at least two exterior walls of the liner.

A refrigerator appliance includes a refrigerator compartment, a freezer compartment, and a convertible compartment. The convertible compartment is defined by a liner and is configured to selectively transition between a secondary refrigerator compartment and a secondary freezer compartment. The appliance further includes a heat pump having a main condenser, a compressor connected in fluid communication with the main compressor, and a secondary condenser configured to heat the convertible compartment and in fluid communication with the main compressor, wherein the secondary condenser includes a coil wrapped around an exterior of the liner.

A refrigerator appliance includes a refrigerator compartment, a freezer compartment, and a convertible compartment. The convertible compartment is defined by a liner and is configured to selectively transition between a secondary refrigerator compartment and a secondary freezer compartment. The appliance further includes a heating coil associated with a heat pump of the refrigerator appliance. The heating coil is wrapped around an exterior of the liner with the coil extending over at least two exterior walls of the liner. A valve fluidly is connected to the heating coil and is configured to control fluid flow through the heating coil.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
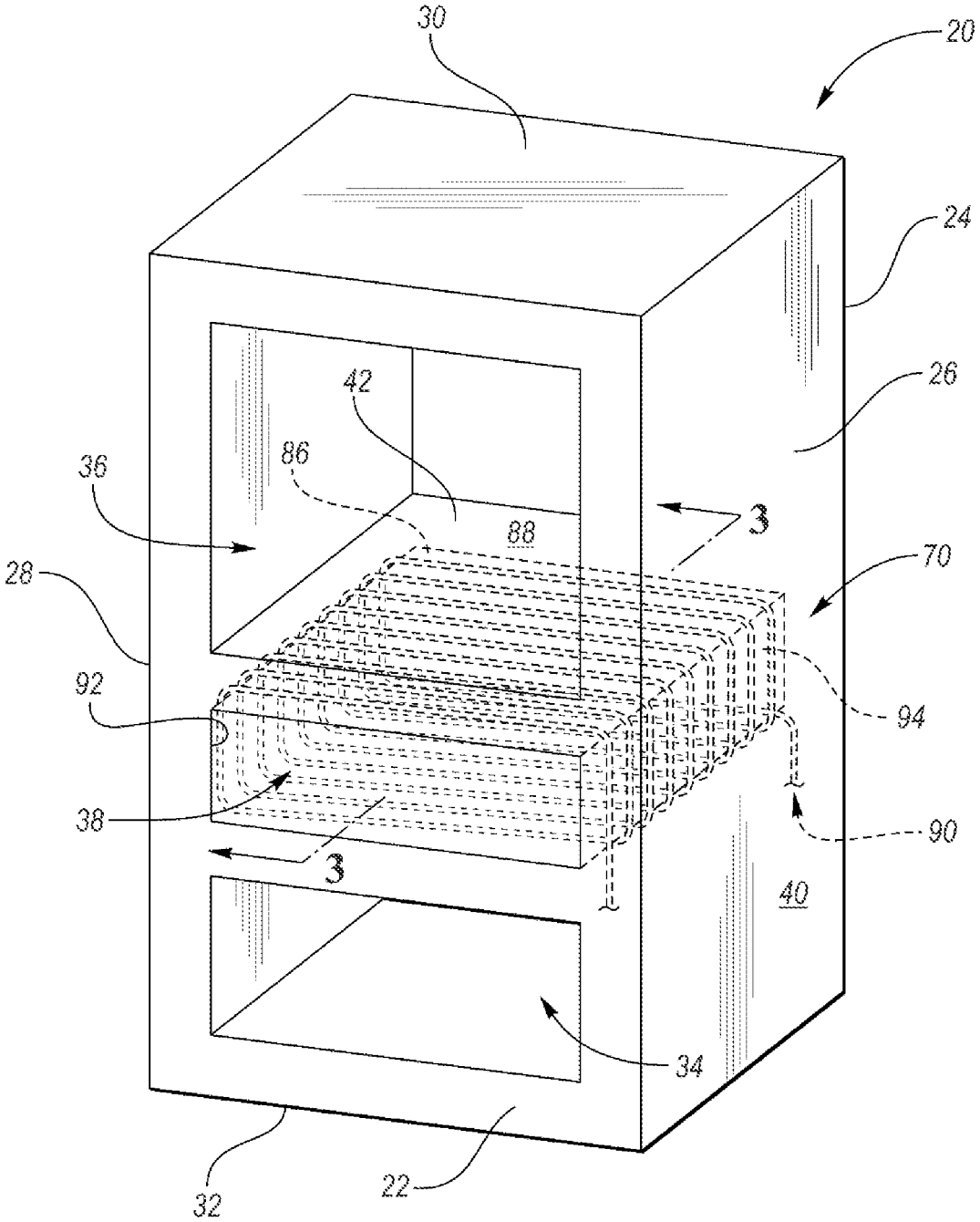
FIG. 1 is a front perspective view of a refrigerator appliance with the doors omitted for illustrative purposes.

Referring to FIG. 1, generally a refrigerator appliance 20 includes a front 22, a back 24, sides 26, 28, a top 30, and bottom 32. The appliance 20 may include a refrigerator compartment 34, a freezer compartment 36, and a convertible compartment 38. A convertible compartment is a compartment that can selectively act as a secondary refrigerator (e.g., temperatures between 34 and 40 degrees F.) or a secondary freezer (e.g., less than zero degrees F.) based on user need. For example, the appliance 20 may include a user interface allowing the user to select refrigerator temperatures or freezer temperatures for the convertible compartment 38. The convertible compartment 38 provides a flex space allowing the user to expand the refrigerator or freezer section of the appliance 20 as needed.

The compartments 34, 36, 38 are defined by one or more liners 42 of the appliance 20. For example, a single liner may be used to define all of the compartments 34, 36, 38. Alternatively, the appliance 20 may include multiple liners such as a liner associated with each of the compartments. The liner(s) includes sidewalls that cooperate to define the compartments. For example, each compartment is defined by five sidewalls of the one or more liners. The compartments are open on the front 22 to provide access. One or more doors (not shown) open and close the compartments 34, 36, 38. The one or more doors may be pivotally connected to the front 22 or may be pullout doors, e.g., slide open and closed. The one or more liners may be formed of plastic or other suitable material.

The one or more liners 42 is encased by exterior panels 40 of the appliance 20. An insulating material, such as an insulating foam, may be disposed between the exterior panels 40 and the liner(s) 42 in order reduce heat transfer with the ambient surroundings and increase the efficiency of the appliance 20.

Figure 2:
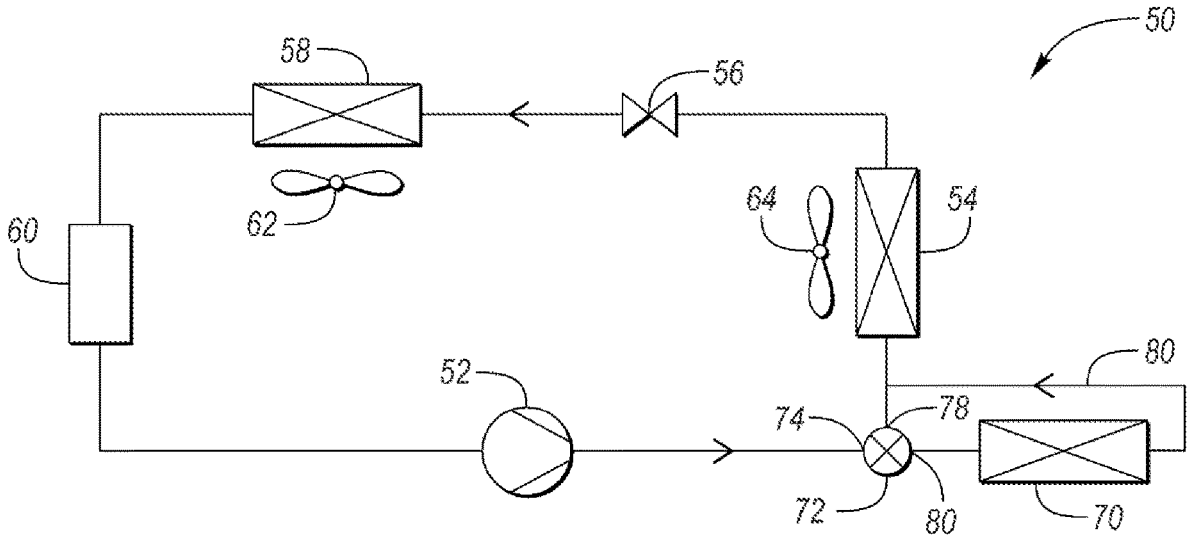
FIG. 2 is a schematic diagram of a heat pump of the refrigerator appliance.

Referring to FIG. 2, one or more vapor-compression heat pump systems 50, which are also known as refrigeration systems, thermally regulate the appliance 20. The heat pump 50 is configured to circulate a refrigerant, e.g., R-134a, in order to heat or cool the compartments of the appliance 20. The heat pump 50 includes at least a compressor 52, a main condenser 54 that rejects heat to ambient surroundings, a thermal expansion device 56, an evaporator 58 that cools air being delivered to the refrigerator compartment 34, the convertible compartment 38, and/or the freezer compartment 36, and an accumulator 60. Of course, the heat pump 50 may include additional components as is known in the art. Fans 62, 64 may be utilized to direct air across the evaporator 58 and the condenser 54 to facilitate heat exchange. The appliance 20 may include air ducts that circulate cold air to the various compartments of the appliance. The arrangement of the air ducts depends upon the number of evaporators provided. In one embodiment, the heat pump system 50 includes a single evaporator, e.g., evaporator 58, that is responsible for cooling all of the compartments 34, 36, and 38. Here, the air ducts are configured to circulate the cold air from the evaporator 58 to all of the compartments as needed. In an alternative arrangement, multiple evaporators are used to directly cool an associated one or more compartments thus reducing the need for air ducts. Air ducts may not be required if each compartment includes a dedicated evaporator. Multiple evaporators may be provided by either adding additional evaporators to a single heat pump or using multiple, separate heat pumps.

The compressor 52 and the fans 62 and 64 may be connected to a controller. Sensors that measure the air temperature within the compartments 34, 36, 38 may also be in communication with the controller. The controller may be configured to operate the compressor, fans, ducts, etc. in response to the air temperature within the compartments being outside of thresholds or in response to a user changing the state of the convertible compartment. Such a controller may be part of a larger control system and may be controlled by various other controllers throughout the appliance 20, and one or more other controllers can collectively be referred to as a "controller" that controls various functions of the appliance 20 in response to inputs or signals to control functions of the appliance 20. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the appliance 20.

Switching the convertible compartment 38 between the refrigeration state and the freezer state requires a temperature change of approximately 30-40 degrees F., for example. That is, the convertible compartment 38 must be heated when changing from the freezer state to the refrigeration state and must be cooled when changing from the refrigeration state to the freezer state. Ideally, this temperature change will occur quickly while minimizing the consumption of energy.

Figure 3:
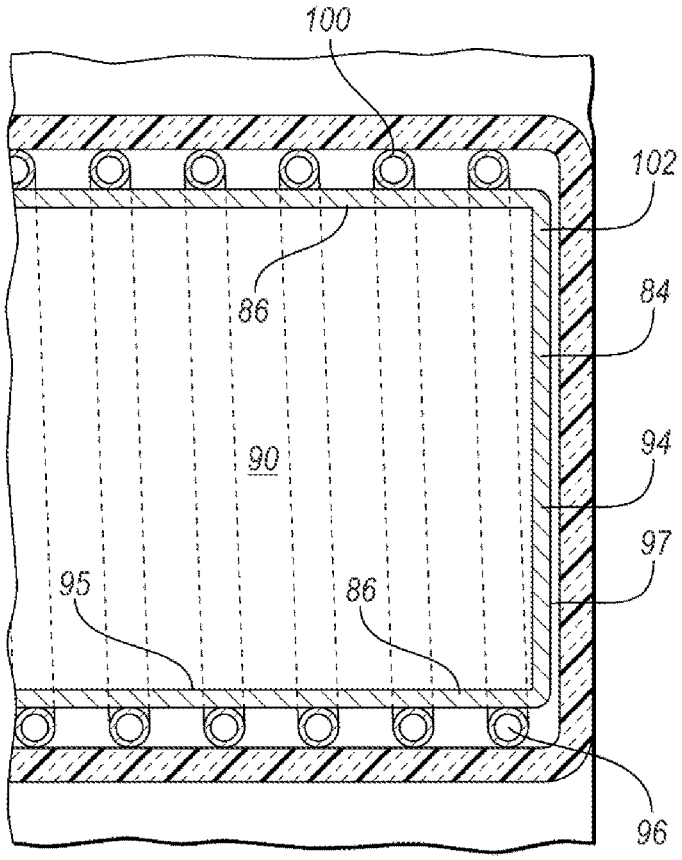
FIG. 3 is a partial side cross-sectional view of a convertible compartment of the refrigerator appliance.

Referring to FIGS. 1, 2, and 3, the appliance 20 includes a heat source associated with the convertible compartment 38. The heat source may be controllable by a controller of the appliance. The controller may be programmed to activate the heat source to switch from the freezer state to the refrigeration state. The heat source may be a heat exchanger of a heat pump of the appliance 20. For example, the heat pump 50 includes a secondary condenser 70 arranged to selectively heat the convertible compartment 38. The secondary condenser 70 may be controlled by an electronic valve 72 that is controllable by the controller. The valve 72 selectively connects the compressor 52 in fluid communication with the condenser 70. When the valve 72 is in one or more closed positions, refrigerant bypasses the condenser 70 and when the valve 72 is in one or more open positions, hot, gaseous refrigerant flows to the condenser 70. The condenser 70 is configured to reject heat from the refrigerant and into the convertible compartment 38. The amount of heat being provided by the condenser 70 can be controlled by controlling the compressor 52 and/or the valve 72.

In the example heat pump 50, the valve 72 is disposed downstream of the compressor 52 and upstream of the primary condenser 54. Placing the secondary condenser 70 upstream of the primary condenser 54 reduces the workload on the primary condenser 54 and may allow the speed of the condenser fan 64 to be reduced thus improving energy efficiency of the system 50. The valve 72 may be a three-way valve having an inlet 74 connected to the compressor 52, a first outlet 76 connected to the secondary condenser 70, and a third outlet 78 connected to the primary condenser 54. The valve 72 may be configured to always provide refrigerant from the inlet 74 to the outlet 78 (primary condenser) and to selectively provide refrigerant from the inlet 74 to the outlet 76 (secondary condenser). Alternatively, the valve may be configured to route 100 percent of the referent to the outlet 76. A supply conduit 80 may connect from the outlet 76 to an inlet of the secondary compressor 70 and a return conduit 82 may connect the outlet of the secondary condenser 70 to the mainline of the heat pump 50, such as by a T-fitting or the like.

The secondary condenser 70 may be in contact with a liner 84 or a portion of the liner 42 depending upon the construction of the liner (as discussed above). The liner or liner portion 84 may include five sides such as a top 86, a bottom 88, sidewalls 90 and 92, and a back 94. Each of theses sides includes an interior surface 95 and an exterior surface 97. The interior surfaces of these five sides cooperate to define the convertible compartment 38. The secondary condenser 70 may include a coil 96 (sometimes called a heating coil) that is wrapped around the exterior surfaces of the liner 84 such that the coil 96 extends over at least two of the five sides. In the illustrated embodiment, the coil 96 extends over four sides of the liner 84, e.g., the top 86, the bottom 88, and the sidewalls 90 and 92. Of course, the coil 96 may extend over three sides in other embodiments. Faster heating of the convertible compartment 38 may be achievable by completely encircling the convertible compartment 38 with the coil 96 as shown in FIGS. 1 and 3. The coil 96 may wrap around the four sides of the liner 84 multiple times. In the illustrated example, the coil 96 wraps around the convertible compartment 12 times so that the coil is present along a majority of the depth direction of convertible compartment 38. However, this is just an example and the size of the coil 96 may be increased or decreased based on heating needs.

The coil 96 includes one or more sections of interconnected tubing 100 configured to carry the refrigerant. The coil may be formed from a single tube that is bent to form the sections or may be constructed from multiple, joined segments of tubing. The tubing 100 may be disposed under the insulation layer 102 and in direct contact with the exterior surfaces 97 of the sides. For example, the tubing 100 may be secured against the exterior sides 97 by metallic tape or the like. Placing the tubing 100 in direct contact with the liner 84 may increase the thermal efficiency of the system. The tubing 100 may be metal such as cooper, aluminum, or other suitable material.

Figure 4:
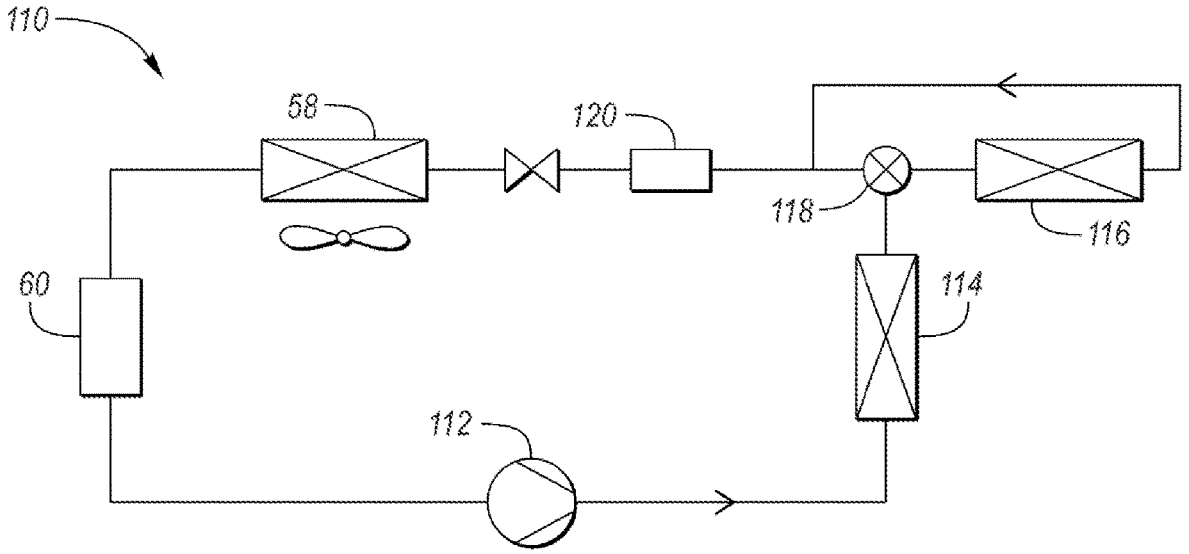
FIG. 4 is a schematic diagram of a heat pump of the refrigerator appliance according to an alternative embodiment.

While the valve associated with the secondary condenser is shown as being between the compressor and primary condenser in the above-described example, this need not be the case in all embodiments. FIG. 4 illustrates another example placement of the valve and the secondary condenser. Referring to FIG. 4, another heat pump 110 includes a compressor 112, a primary condenser 114, a secondary condenser 116, and a valve 118. In this example, the valve 118 has been moved downstream of the primary condenser 114. The valve 118 selectively routes refrigerant to the secondary condenser 116 as described above. The valve 118 may include an inlet connected in fluid communication to an outlet of the primary condenser 114, a first outlet connected in fluid communication with a drier 120 and a second outlet connected in fluid communication with the secondary condenser 116. The structure of the valve 118 may be the same or similar to the valve 72. The valve 118 may be in electric communication with a controller that selectively routes refrigerant to the secondary condenser 116 when the convertible compartment 38 requires heating and that selectively severs fluid communication with the secondary condenser 116 when the convertible compartment does not require heating.

Figure 5:
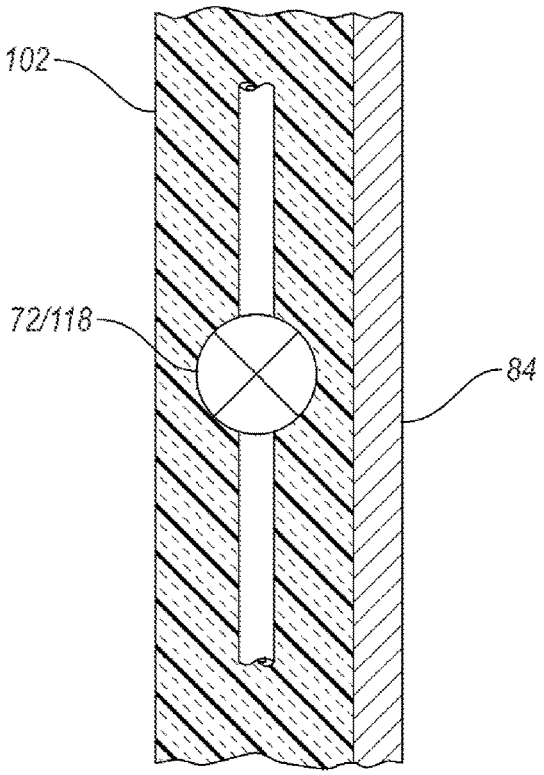
FIG. 5 is a diagrammatical view, in cross section, illustrating one possible placement location for a valve associated with a secondary condenser.

Referring to FIG. 5, the valve 72/118 may be positioned at various locations within the appliance 20. For example, the valve 72/118 may be placed in the machine compartment, which is generally disposed on the bottom and/or the back of the appliance 20. Alternatively, as is shown in FIG. 5, the valve 72/118 may be nearer to the heating coil 96 and embedded within or under the insulation layer 102.

The above-described heating system for the convertible compartment 38 allows the compartment to be heated without adding an additional energy draw, such as an electric heater. The solution also does not require reducing thermal efficiency, e.g., less insulation, in order to heat the convertible compartment quickly. Instead, the appliance 20 takes advantage of the already present heat pump and simply adds, for example, an additional heat exchanger and valve in order to selectively discharge some of the already-present waste heat to the convertible compartment rather than rejecting all of it to the atmosphere at the primary condenser.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:
- a refrigerator compartment;
- a freezer compartment;
- a convertible compartment defined by a liner and configured to selectively transition between a secondary refrigerator compartment and a secondary freezer compartment; and
- a heating coil directly disposed on the liner to wrap over at least two exterior walls of the liner, wherein the heating coil is configured to heat the convertible compartment by conductively heating the liner via direct contact therewith.

2. The refrigerator appliance of claim 1, wherein the heating coil is configured to circulate refrigerant.

3. The refrigerator appliance of claim 1, further comprising a compressor selectively in fluid communication with the heating coil and a main condenser.

4. The refrigerator appliance of claim 3, wherein the heating coil is connected downstream of the compressor and upstream of the main condenser.

5. The refrigerator appliance of claim 4 further comprising a valve including an inlet connected to the compressor, a first outlet connected to the main compressor, and a second outlet connected to the heating coil, wherein the valve includes a first position in which the inlet is connected in fluid communication with the second outlet and a second position in which the inlet is fluidly severed from the second outlet.

6. The refrigerator appliance of claim 3, wherein the heating coil is connected downstream of the main condenser.

7. The refrigerator appliance of claim 1 further comprising:
- a valve in fluid communication with the heating coil; and
- an insulation layer surrounding the liner, wherein the valve is disposed within the insulation layer.

8. The refrigerator appliance of claim 1, wherein the heating coil extends over at least three exterior walls of the liner.

9. The refrigerator appliance of claim 1, wherein the heating coil extends over at least four exterior walls of the liner.

10. The refrigerator appliance of claim 1, wherein the refrigerator compartment is defined by a second liner and the freezer compartment is defined by a third liner.

11. The refrigerator appliance of claim 10, wherein the liner, the second liner and the third liner are integrally formed.

12. A refrigerator appliance comprising:
- a refrigerator compartment;
- a freezer compartment;
- a convertible compartment defined by a liner and configured to selectively transition between a secondary refrigerator compartment and a secondary freezer compartment; and
- a heat pump including:
- a main condenser,
- a compressor connected in fluid communication with the main compressor, and
- a secondary condenser in fluid communication with the main compressor and including a coil in direct contact with an exterior of the liner and wrapped around at least two sides of the liner, wherein the heat pump is configured to circulate hot refrigerant though the coil such that the liner conducts heat from the coil via direct contact therewith when the convertible compartment transitions from the freezer compartment to the refrigerator compartment.

13. The refrigerator appliance of claim 12, wherein the coil extends over at least three exterior walls of the liner.

14. The refrigerator appliance of claim 12, wherein the coil extends over at least four exterior walls of the liner.

15. The refrigerator appliance of claim 12, wherein the heat pump further includes a valve that selectively connects the compressor and the secondary condenser in fluid communication.

16. The refrigerator appliance of claim 15, wherein the valve includes an inlet connected to the compressor, a first outlet connected to the main condenser, and a second outlet connected to the secondary condenser, wherein the valve includes a first position in which the inlet is connected in fluid communication with the second outlet and a second position in which the inlet is fluidly severed from the second outlet.

17. A refrigerator appliance comprising:

a refrigerator compartment;

a freezer compartment;

a convertible compartment defined by a liner and configured to selectively transition between a secondary refrigerator compartment and a secondary freezer compartment;

a heating coil associated with a heat pump of the refrigerator appliance, wherein the heating coil is wrapped around an exterior of the liner with the coil extending over, and in direct contact with, at least two exterior walls of the liner;

an insulation layer disposed over the liner and the heating coil; and a valve fluidly connected to the heating coil and configured to control fluid flow through the heating coil, wherein the valve is actuatable to a first position in which hot refrigerant is circulated to the heating coil such that the liner conducts heat from the heating coil via direct contact therewith.

18. The refrigerator appliance of claim 17, wherein with the coil extends over at least three exterior walls of the liner.

19. The refrigerator appliance of claim 17, wherein the valve is embedded within the insulation layer.

* * * * *